US006469269B1

(12) United States Patent
Jong

(10) Patent No.: US 6,469,269 B1
(45) Date of Patent: Oct. 22, 2002

(54) TWO-STAGE SELF-LOCKING SWITCH STRUCTURE FOR HAND TOOLS

(75) Inventor: Jung-Chang Jong, Chungli (TW)

(73) Assignee: Jenn Feng Industrial Co., Ltd., Taoyuan (TW)

( * ) Notice: Subject to any disclaimer, the term of this patent is extended or adjusted under 35 U.S.C. 154(b) by 0 days.

(21) Appl. No.: 09/825,309

(22) Filed: Apr. 2, 2001

(51) Int. Cl.[7] ..... H01H 9/20

(52) U.S. Cl. ..... 200/522; 200/43.17; 200/332.2; 200/321

(58) Field of Search ..... 200/43.01, 43.11, 200/43.13, 43.16, 43.17, 522, 318, 61.85, 321–325, 329, 330, 332.1, 332.2, 334

(56) References Cited

U.S. PATENT DOCUMENTS 3,847,233 A * 11/1974 Glover et al. ..... 173/170
3,973,179 A * 8/1976 Wever et al. ..... 200/332.2
4,122,320 A * 10/1978 Edgell et al. ..... 200/43.17
4,250,366 A * 2/1981 Erickson et al. ..... 200/325
5,577,600 A * 11/1996 Schoene et al. ..... 200/321
5,638,945 A * 6/1997 Fukinuki et al. ..... 200/318
5,724,737 A * 3/1998 Stones ..... 200/43.17
6,169,258 B1 * 1/2001 Roney et al. ..... 200/321

* cited by examiner

*Primary Examiner*—Michael Friedhofer

(57) ABSTRACT

A two-stage self-locking switch for electric hand tools mainly comprises a trigger base structure, an auto-return switch, a tigger-controlling structure, a trigger structure, and a cover for the trigger base structure. Wherein the trigger-controlling structure pivoted to the trigger base structure comprises namely a button connected with an arresting part on its bottom and a flexible slice on the bottom of its front, and the flexible slice is connected with both an upward extending retaining key and a downward extending reversed hook plate. Whereas, the trigger structure is pivoted to the trigger base structure with respect to the position of the trigger-controlling structure, and on the appropriate positions of the front of the trigger structure corresponding to the arresting part and the reversed hook plate is provided with a resisting plate and a hook plate respectively.

4 Claims, 5 Drawing Sheets

TWO-STAGE SELF-LOCKING SWITCH STRUCTURE FOR HAND TOOLS

FIELD OF THE INVENTION

The present invention relates to a structure of a two-stage self-locking switch for electric hand tools, more particularly to a structure which can provide two self-locking functions for switches: preventing the switch from being mistakenly activated as a result of inattentively touching and enabling switches being activated continuously, through which the safety and convenience in using the hand tools equipped with switches can be enhanced.

BACKGROUND OF THE INVENTION

The electric hand tools for trimming plants are equipped with switches providing the function of turning on and off power, to activate or stop the running of the motor. The prior art of the switches of the electric hand tools includes a trigger base structure, an auto-return switch, a trigger structure, and a cover for the trigger base structure. The traditional trigger structure of the electric hand tool is not equipped with the functions for preventing switch being inattentively activated and for enabling switches being activated continuously; and therefore, mistaken activation of the electric hand tools can easily lead to personnel injury in case of touching inattentively, and long hour of holding the trigger to activate the electric hand tools can be tiring and inconvenient.

Accordingly, the present innovation is to improve the shortcomings of the prior art of the electric hand tools.

SUMMARY OF THE INVENTION

The object of the present invention is to provide a two-stage self-locking switch for electric hand tools, which employs a trigger-controlling structure mounted on the prior art of the electric hand tool and a trigger structure provided with a resisting plate and a hook plate with respect to the trigger-controlling structure. The arresting part provided in the trigger-controlling structure and the resisting plate mounted on the tricker are mutually obstructing each other at the original power-off status when the electric hand tool is not in use, preventing the hand tool from being, mistakenly activated as a result of inattentively touching. Also, when the electric hand tool is in use the electric hand tool can be activated continuously by hooking together the reversed hook plate provided at the trigger-controlling structure and the hook plate mounted on the trigger structure, without the need of holding the trigger structure in the duration of activation.

The present innovation and its aims and functions can be better understood with reference to the following figures.

DETAILED DESCRIPTION OF THE INVENTION

Figure 1:
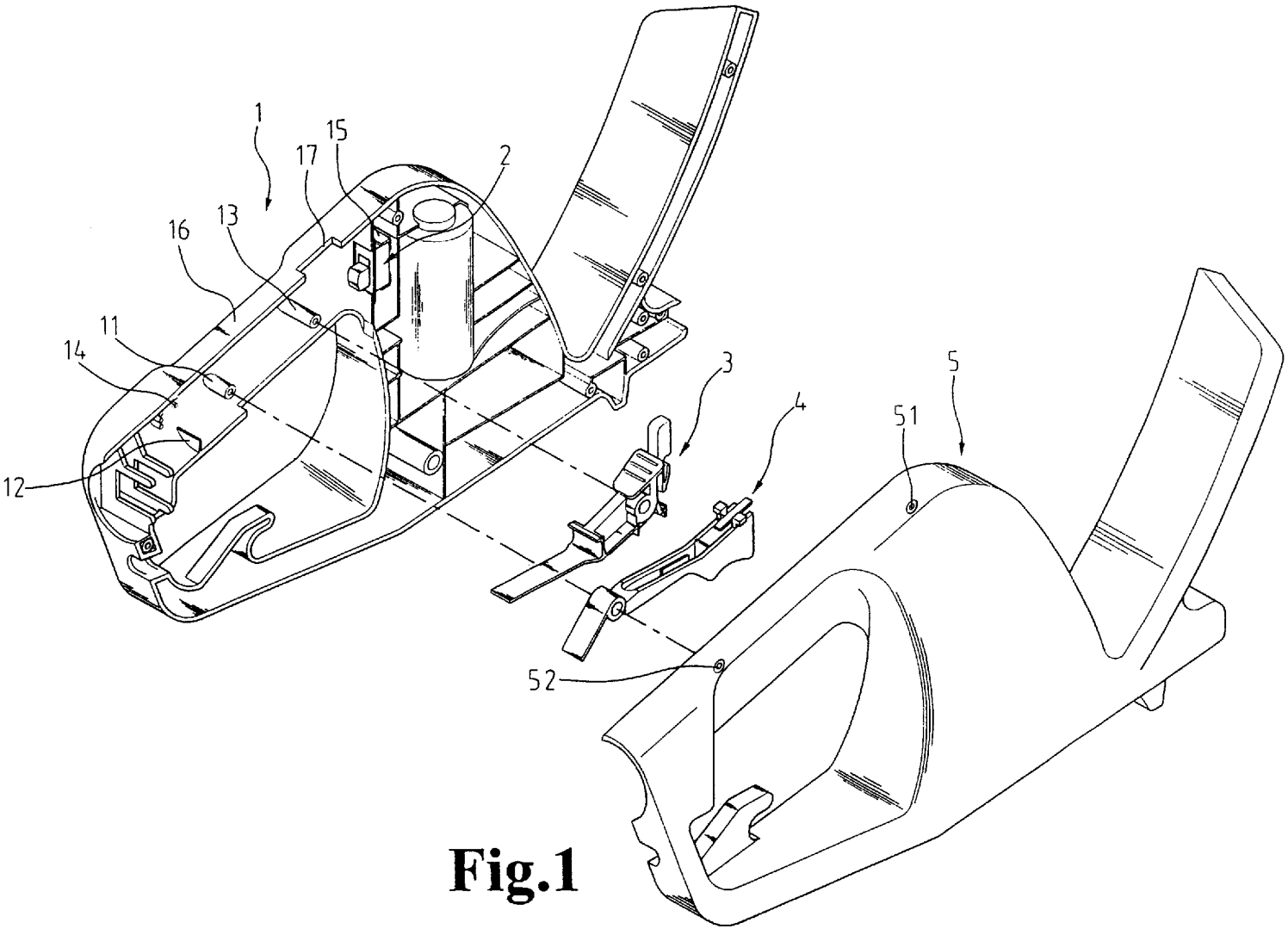
FIG. 1 is an exploded perspective view of the structure of the two-stage self-locking switch for electric hand tools of the present invention.
Figure 2:
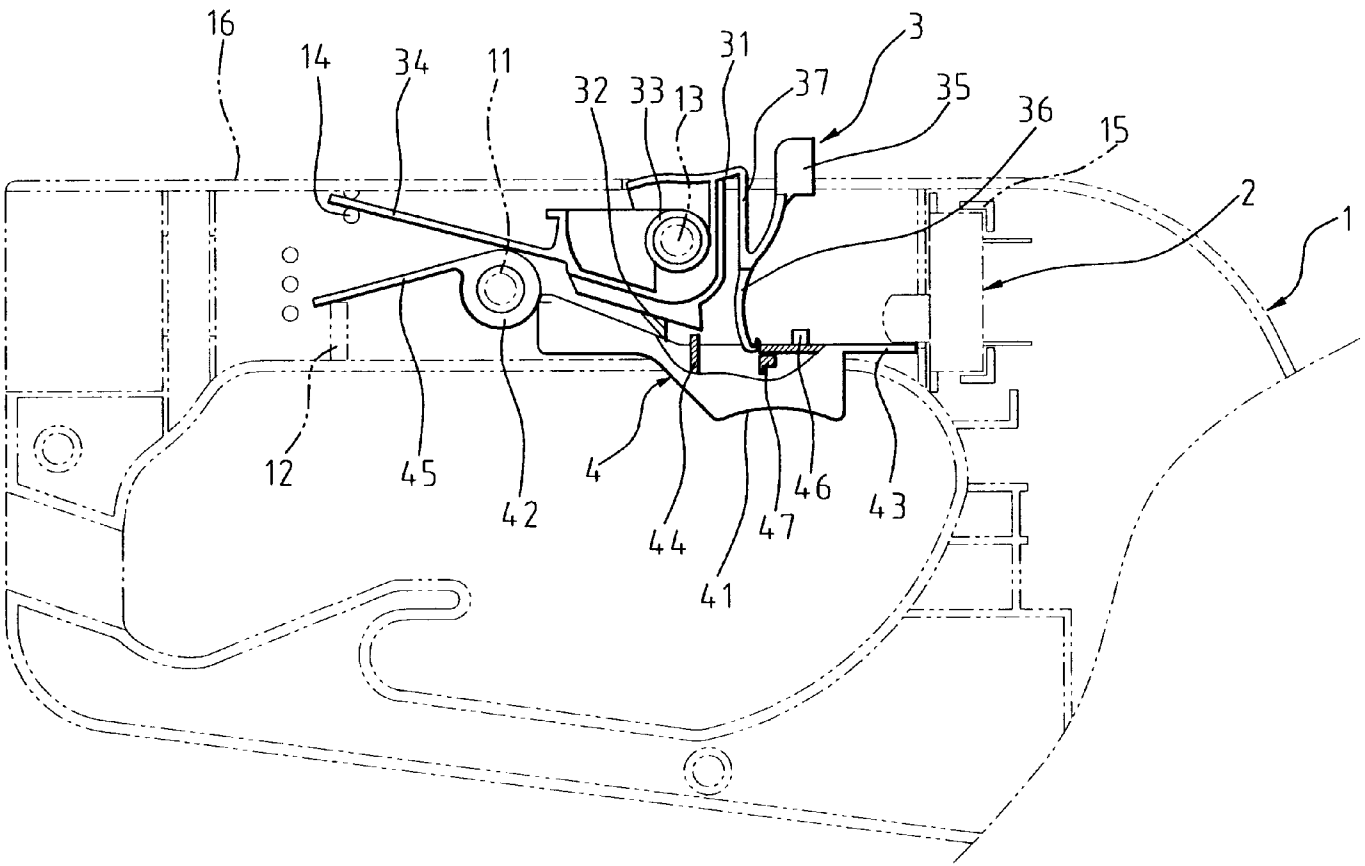
FIG. 2 is a cross-section view for the assembled structure of the two-stage self-locking switch for electric hand tools of the present invention.

As illustrated with reference to FIGS. 1 and 2, one preferred embodiment of the two-stage self-locking switch for electric hand tools of the present invention comprises a trigger base structure 1, an auto-return switch 2, a trigger-controlling structure 3, a trigger structure 4, and a cover 5 for the trigger base structure. The trigger base structure 1 comprises a hand hold 16 behind which a rear pivoting shaft 11, a counteractive plate 12, a front pivoting shaft 13, a counteractive rod 14, a switch seat 15, and an opening 17 are provided at appropriate positions, wherein the auto-return switch 2 is arranged at the switch seat 15. Whereas, the trigger-controlling structure 3 mainly comprises a button 31 pivoted to the front pivoting shaft 13 by a pivot 33. On the rear side of the button 31 is provided with an elastic slice 34 of which one end is mounted on the top of the counteractive rod 14, on the front bottom of the button 31 is provided with a gear-like arresting part 32, and on the bottom of the button 31 is connected with a flexible slice 37 of which the bottom is fixed both to an upward extending retaining key 35 and a downward extending reversed hook plate 36. The trigger structure 4 mainly comprises a trigger switch 41 of which the rear part is a trigger pivot 42 pivoted to the rear pivoting shaft 11, and the rear part of the trigger pivot 42 is an elastic slice 45 of the trigger structure contacted against the counteractive plate 12. The front of the trigger structure 4 is provided with a switch plate 43 contacted against the lower part of the self-return switch 2. The two sides of the front of the trigger structure 4 are fixed respectively to a restricting plate 46 to serve as the lowest limit which the trigger switch 41 can move downwards. At the appropriate position on the interlayer of the front of the trigger structure 4 is provided with a reversed ladder-like book plate 47, and a resisting plate 44 is arranged at the back of the hook plate 47. And the trigger base structure 5 is a near symmetric structure with the trigger structure 1, wherein on its top is arranged with a through hole 51 and a through hole 52 which can be fastened with the rear pivoting shaft 11 and the front pivoting shaft 13 of the trigger structure 1 by screws, respectively.

Figure 3:
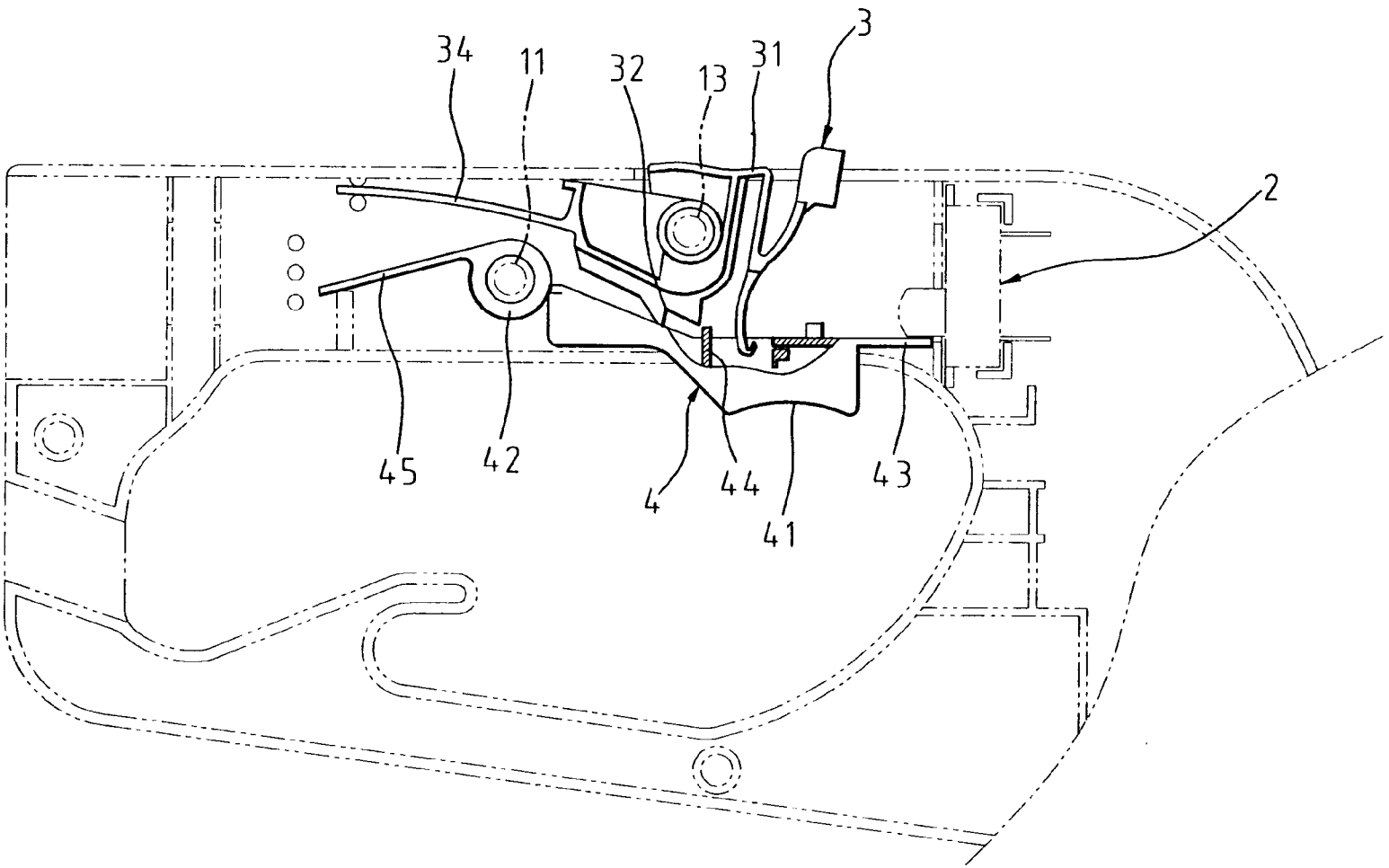
FIG. 3 is a cross-section view for the assembled structure of the two-stage self-locking switch for electric hand tools of the present invention with the trigger-controlling structure being pressed down.
Figure 4:
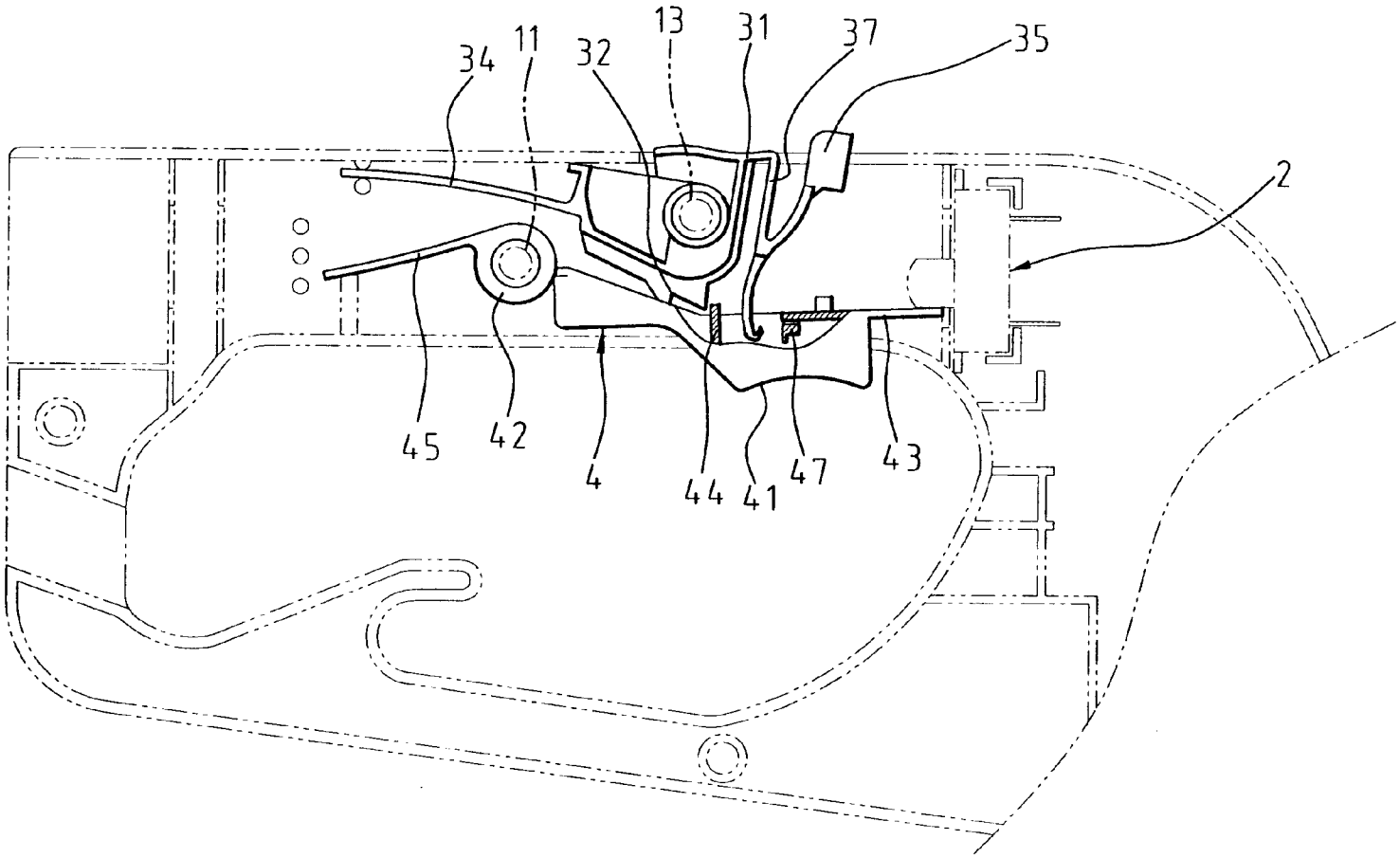
FIG. 4 is a cross-section view for the assembled structure of the two-stage self-locking switch for electric hand tools of the present invention with the trigger-controlling structure being pressed down and the switch trigger being lifted up.
Figure 5:
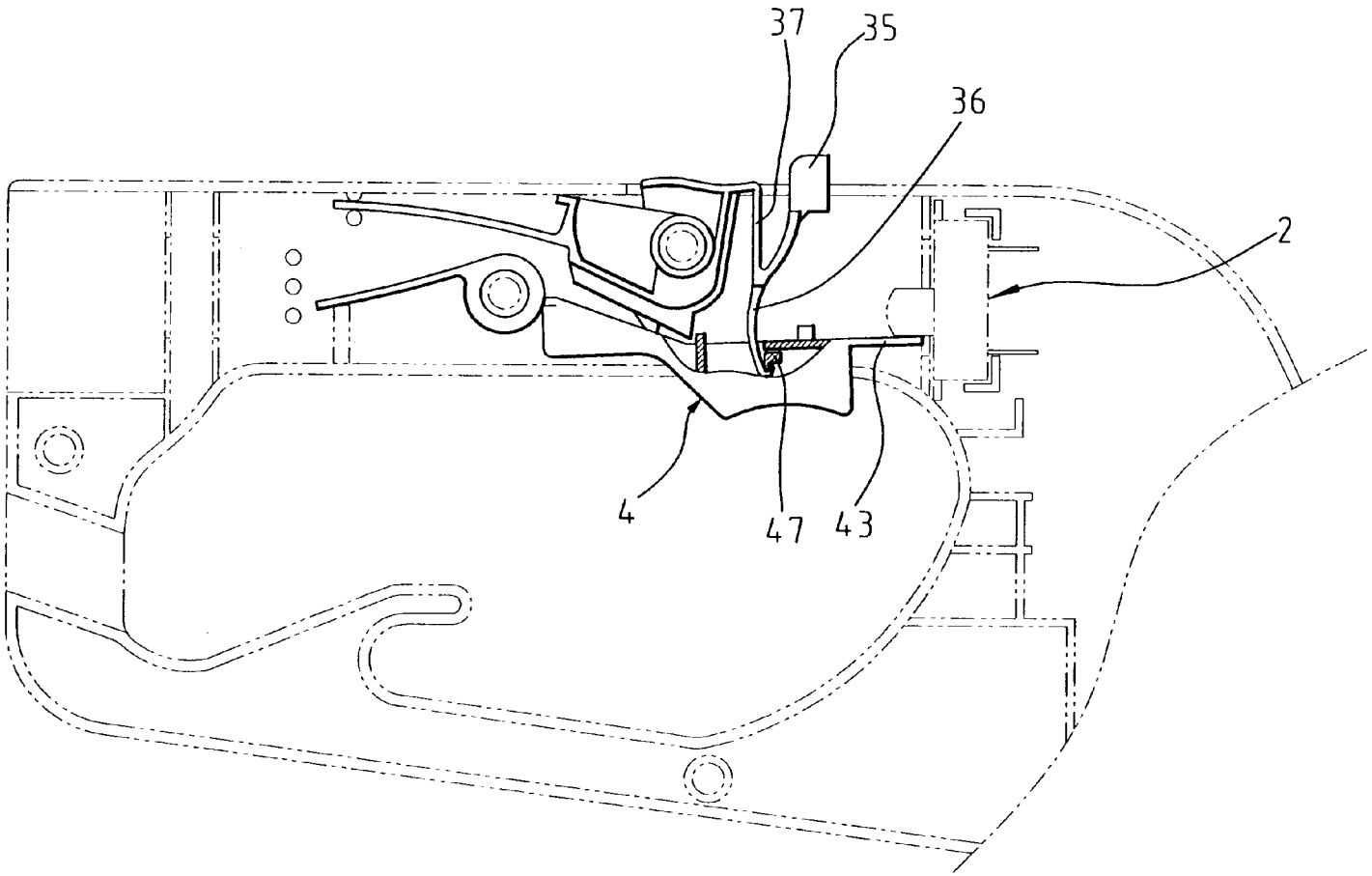
FIG. 5 is a cross-section view for the assembled structure of the two-stage self-locking switch for electric hand tools of the present invention with the reversed hook plate hooking the hook plate to enable the switch being activated continuously.

As illustrated with reference to FIG. 2, one preferred embodiment of the present invention comprises the two-stage self-locking switch for electric hand tools. In the case of the button 31 not being pressed down, the arresting part 32 of the trigger-controlling structure 3 can block the upward movement of the resisting plate 44 driven by the upward-moving trigger switch 35, and therefore the trigger switch 35 is unable to move upwards. As illustrated with reference to FIGS. 3 and 4, if the button 31 is pressed down, the resisting plate 44*c* move upwards easily without the hindrance of the arresting part 32, and the auto-return switch 2 is in turn driven to ON status by the switch plate 43. If the trigger switch 41 and the button 31 are released again, the upward movement of the trigger switch 41 can make the trigger pivot 42 rotate around the rear pivoting shaft 11, a certain amount of residual elastic force is generated on the deformed elastic slice 45 of the trigger structure which in turn prompts the trigger switch 41 to drive the switch plate 43 back to its original position. The auto-return switch 2 will also return to the OFF status after losing the supporting force. In the mean time, the button 31 and the arresting pan 32 situated above the button 31 will also return to their original positions. Furthermore, as illustrated with reference to FIG. 4, in the case of pressing down the button 31 and moving the trigger switch 41 upwards to drive the auto-return switch 2 to ON status, moving the retaining key 35 backwards (as shown in FIG. 5) will cause the flexible slice 37, pivoting on its one side according to the lever rule, to prompt the reversed hook plate 36 moving forwards to hook to the ladder-like hook plate 47. At this moment, if the trigger switch 41 and the button 31 are released, the trigger structure 4 and the trigger-controlling structure 3 will not return to their original positions because the hook plate 47 is hooked to the reversed hook plate 36, making the auto-return switch maintain at the ON status continuously. But, if the button 31 is being pressed down, the reversed hook plate 36 will release the hook plate 47, making the trigger structure 4 and the trigger-controlling structure 3 return to their original positions and, in turn, the auto-return switch will return to OFF status.

It should be understood that the above only describes an example of one embodiment of the present invention, and that various alternations or modifications may be made thereto without departing the spirit of this invention. Therefore, the protection scope of the present invention should be based on the claims described later.

What is claimed is:

1. A two-stage self-locking switch for electric band tools comprising:

a trigger base structure;

a switch seat;

an auto-return switch arranged in said switch seat;

a trigger-controlling structure pivoted to said switch seat, said trigger-controlling structure being provided with at least an arresting part and an elastic slice, and said trigger-controlling structure being connected to a rear part of said switch seat so as to secure said elastic slice to said switch seat; and a trigger structure being pivoted to said switch seat and comprising a triggering switch having a top provided with a resisting plate, two ends of said triggering switch being arranged with a switch plate and an elastic slice of said trigger structure respectively, said elastic slice of said trigger structure contacting said trigger base structure;

wherein when no external force is applied to said trigger structure, said arresting part sets against said resisting plate, making said trigger switch unable to be pressed; and when said tigger-controlling structure is pressed, said arresting part is moved away from said resisting plate, making said trigger switch able to be pressed.

2. A two-stage self-locking switch for electric hand tools according to claim 1, wherein said trigger controlling structure is arranged with a downward extending flexible slice, a lower end of said flexible slice is provided with a reversed hook plate, said trigger structure has a top provided with a hook plate, and upon pressing said trigger controlling structure and said trigger switch one by one, said reversed hook plate is hooked to said hook plate and in turn said trigger structure is maintained at PRESS status, while turning said trigger controlling structure to an opposite direction separates said reversed hook plate and said hook plate.

3. A two-stage self-locking switch for electric hand tools according to claim 1, wherein said elastic slice and said trigger-controlling structure are manufactured as an integral part.

4. A two-stage self-locking switch for electric hand tools according to claim 1, wherein said elastic slice of said trigger structure and said trigger structure are manufactured as an integral part.

* * * * *